US008052342B2

(12) United States Patent
Rosenzweig et al.

(10) Patent No.: US 8,052,342 B2
(45) Date of Patent: Nov. 8, 2011

(54) UNIVERSAL CONNECTOR FOR A FLUID MOP

(75) Inventors: Maximilian Rosenzweig, Montreal (CA); Ognjen Vrdoljak, Laval (CA)

(73) Assignee: Euro-Pro Operating LLC, Newton, MA (US)

( * ) Notice: Subject to any disclaimer, the term of this patent is extended or adjusted under 35 U.S.C. 154(b) by 0 days.

(21) Appl. No.: 12/118,015

(22) Filed: May 9, 2008

(65) Prior Publication Data

US 2009/0279938 A1 Nov. 12, 2009

(51) Int. Cl.
*A46B 11/00* (2006.01)

(52) U.S. Cl. ..... 401/140; 401/268

(58) Field of Classification Search ..... 401/137–140, 401/268, 292; 285/272
See application file for complete search history.

(56) References Cited

U.S. PATENT DOCUMENTS

| | | | | |
|---|---|---|---|---|
| 1,643,637 | A * | 9/1927 | Chadwick | 15/228 |
| 1,720,165 | A | 7/1929 | Bloom | |
| 2,053,282 | A | 9/1936 | Gewalt | |
| 3,145,406 | A | 8/1964 | Lay | |
| 3,188,671 | A | 6/1965 | Kane | |
| 3,782,837 | A * | 1/1974 | Feldmann | 401/281 |
| 4,073,030 | A | 2/1978 | Albishausen | |
| 4,074,387 | A | 2/1978 | Arato et al. | |
| 4,114,223 | A | 9/1978 | Buchanan | |
| 4,327,459 | A | 5/1982 | Gilbert | |
| 4,564,308 | A | 1/1986 | Ikegami et al. | |
| 4,584,736 | A | 4/1986 | Gremminger | |
| 4,905,712 | A | 3/1990 | Bowlin et al. | |
| 4,971,471 | A * | 11/1990 | Sloan | 401/203 |
| 5,080,517 | A | 1/1992 | Lynn | |
| 5,165,866 | A | 11/1992 | Kato | |
| 5,271,682 | A * | 12/1993 | Realdon | 401/37 |
| 5,419,015 | A | 5/1995 | Garcia | |
| 5,455,980 | A | 10/1995 | Buchanan | |
| 5,988,920 | A | 11/1999 | Kunkler et al. | |
| 6,123,478 | A * | 9/2000 | Giles | 401/219 |

(Continued)

FOREIGN PATENT DOCUMENTS

CH 429 211 A 1/1967

(Continued)

OTHER PUBLICATIONS

Patent Abstracts of Japan, vol. 2002, No. 03, Apr. 3, 2002, Publication No. 2001327449 (Alpha Homes: KK), Nov. 21, 2001.

(Continued)

*Primary Examiner* — David Walczak
(74) *Attorney, Agent, or Firm* — Wolf, Greenfield & Sacks, P.C.

(57) ABSTRACT

A universal connector for connecting a mop frame to a fluid source. The universal connector includes an upper connector piece with a proximal end for connection to a mop housing and a distal end with a pair of pivot arms. A fluid distributor having a hollow nipple portion connects to the fluid source and has a pair of pivot plates for pivotal connection to the upper connection piece for side to side pivot. Fluid distributor also has a pair of opposed elongated hollow arms for coupling to a mop frame. A fluid conduit passing through the upper connector piece from the fluid source and connected to the nipple portion of the distributor for distribution of fluid to the mop frame through the hollow distributor arms. Fabric mop pockets with an opening to permit rotation of the mop frame about the distributor.

22 Claims, 10 Drawing Sheets

U.S. PATENT DOCUMENTS

| | | | | |
|---|---|---|---|---|
| 6,289,551 | B1 | 9/2001 | Basile | |
| 6,490,753 | B1 | 12/2002 | Chen | |
| 6,571,421 | B1 | 6/2003 | Sham et al. | |
| 6,644,877 | B1 * | 11/2003 | Chen | 401/140 |
| D522,201 | S | 5/2006 | Davis-Wilson et al. | |
| 7,266,292 | B1 | 9/2007 | Tsai | |
| 7,340,795 | B2 | 3/2008 | Kaleta | |
| 7,380,307 | B2 | 6/2008 | Tsai | |
| 7,591,039 | B2 | 9/2009 | Kaleta et al. | |
| 2002/0094285 | A1 | 7/2002 | Paolini et al. | |
| 2002/0106970 | A1 | 8/2002 | Falla | |
| 2002/0112744 | A1 | 8/2002 | Besseling | |
| 2002/0194693 | A1 | 12/2002 | Wu | |
| 2003/0041578 | A1 | 3/2003 | Fuller | |
| 2003/0089383 | A1 | 5/2003 | Biggs | |
| 2003/0133738 | A1 | 7/2003 | Hall et al. | |
| 2004/0134016 | A1 | 7/2004 | Kisela | |
| 2004/0146332 | A1 | 7/2004 | Fu | |
| 2004/0178284 | A1 | 9/2004 | Fahy et al. | |
| 2005/0254882 | A1 | 11/2005 | Hofte et al. | |
| 2006/0000049 | A1 | 1/2006 | Rosenzweig | |
| 2006/0000241 | A1 | 1/2006 | Rosenzweig | |
| 2007/0130719 | A1 | 6/2007 | Zhou | |
| 2010/0186463 | A1 | 7/2010 | Vrdoljak et al. | |
| 2010/0269282 | A1 | 10/2010 | Kaminer et al. | |
| 2010/0272948 | A1 | 10/2010 | Kaminer et al. | |

FOREIGN PATENT DOCUMENTS

| | | | |
|---|---|---|---|
| CN | 1368032 | A | 9/2002 |
| CN | 2540155 | Y | 3/2003 |
| CN | 2568117 | Y | 8/2003 |
| CN | 1704011 | A | 12/2005 |
| CN | 200957065 | Y | 10/2007 |
| DE | 24 31 102 | A1 | 1/1976 |
| DE | 91 10 171 | U1 | 3/1993 |
| DE | 298 22 052 | U1 | 2/1999 |
| DE | 299 10 658 | U1 | 9/1999 |
| DE | 200 01 462 | U1 | 1/2001 |
| DE | 100 15 941 | A1 | 10/2001 |
| DE | 102 05 507 | A1 | 8/2003 |
| DE | 20310392 | U1 | 12/2003 |
| DE | 20 2006 001189 | U1 | 4/2006 |
| EP | 1 027 855 | A | 8/2000 |
| EP | 1 224 899 | A | 7/2002 |
| EP | 1380248 | A2 | 1/2004 |
| EP | 1 554 968 | A | 7/2005 |
| EP | 1704808 | A1 | 9/2006 |
| FR | 601 312 | A | 2/1926 |
| FR | 709 689 | A | 8/1931 |
| FR | 2 282 252 | A | 3/1976 |
| GB | 1 449 483 | | 8/1973 |
| GB | 2 294 196 | A | 4/1996 |
| GB | 2 416 526 | A | 2/2006 |
| JP | 2001327449 | A | 11/2001 |
| JP | 2004337454 | A | 12/2004 |
| WO | WO 98/23385 | A | 6/1998 |
| WO | WO 99/26522 | A | 6/1999 |
| WO | WO 01/22861 | A2 | 4/2001 |
| WO | WO 02/43550 | A | 6/2002 |
| WO | WO 2005/074781 | A2 | 8/2005 |
| WO | WO 2007/065371 | A | 6/2007 |
| WO | WO 2008/016741 | | 2/2008 |

OTHER PUBLICATIONS

EURO-PRO Operating LLC; Steam Shark II Owner'S Manual Model EP908EF; Nov. 2003; St. Laurent, Quebec H4S 1A7, pp. 1-39.

EURO-PRO Operating LLC; Portable Shark Steam Cleaner Owner's Manual Model SC505; Jan. 2003; p. 7; Champlain, NY 12919, pp. 1-11.

International Search Report & Written Opinion from corresponding PCT/US2009/043339 mailed Dec. 2, 2009.

International Preliminary Report on Patentability for PCT/US2009/043339 mailed Nov. 18, 2010.

Search Report for Chinese Application No. 200990000004.2, dated May 4, 2011.

* cited by examiner

UNIVERSAL CONNECTOR FOR A FLUID MOP

BACKGROUND OF THE INVENTION

The invention relates generally to a fluid mop, and more particularly to a universal connector for connecting a mop frame to a fluid source in the mop housing.

Wet and dry mops have been widely used for cleaning floors. A type of wet mop is a steam mop, which works as a steaming device.

Steaming devices used to apply steam to household objects are well known. The uses of the devices vary widely, and may include the application of steam to drapes or other fabrics to ease wrinkles, and the application of steam to objects to assist in cleaning the objects.

Typical steam devices have a reservoir for storing water that is connected to an electrical water pump with an on/off switch. The exit from the electric water pump is connected to a steam boiler with a heating element to heat the water. The heated water generates steam, which may be directed towards its intended destination through a nozzle which controls the application of the steam. Variation of the shape and size of the nozzle allows for preferred distribution of generated steam to an object to be cleaned. The nozzles may be disconnectable from the steam generator to allow different nozzles to be utilized, based on the object to be steamed. The nozzle may be either closely coupled to the steam generator, or located at a distance from the steam generator, requiring tubing or other steam transfer structures to be interconnected between the steam generator and the discharge nozzle. Typically, these connections provide suitable limited steering capabilities.

Accordingly, it is desirable to provide a universal connector for connecting the mop frame to a fluid source for changing the angle between the housing and frame, to provide a full range of steering and that easily disconnects from the mop frame.

SUMMARY OF THE INVENTION

Generally speaking, in accordance with the invention, a universal connector for connecting a mop frame to a fluid source in a mop housing and having improved steering features is provided. The universal connector includes an upper connector piece connected to the mop housing at one end and having a pair of parallel pivot arms extending to the mop frame at the other end. The pivot arms are pivotally connected to a fluid distributor having a complimentary pair of pivot arms for pivotally connecting to the upper connector. The distributor has a pair of opposed elongated hollow arms for coupling to a mop frame and a hollow nipple portion for connecting to the fluid source. The end of the distributor arms are adapted to engage the mop frame and provide an axis to pivot the connector in an up and down direction. A flexible fluid conduit passes through the upper connector piece and is connected to the nipple portion of the fluid distributor for distribution of fluid to the mop frame through the hollow distributor arms.

Accordingly, it is an object of the invention to provide a universal connector that easily connects and disconnects a mop frame to a fluid source.

Another object of the invention is to provide a connector for a mop that allows for turning over a mop frame for improved cleaning.

Yet a further object of the invention is to provide a universal connector that provides a full range of steering for mop frames.

Still other objects and advantages of the invention will in part be obvious and will in part be apparent from the specification.

The invention accordingly comprises a product possessing the features, properties, and the relation of components which will be exemplified in the product hereinafter described, and the scope of the invention will be indicated in the claims.

BRIEF DESCRIPTION OF THE DRAWINGS

For a fuller understanding of the invention, reference is made to the following description taken in connection with the accompanying drawing(s), in which.

DETAILED DESCRIPTION OF THE INVENTION

Figure 1:
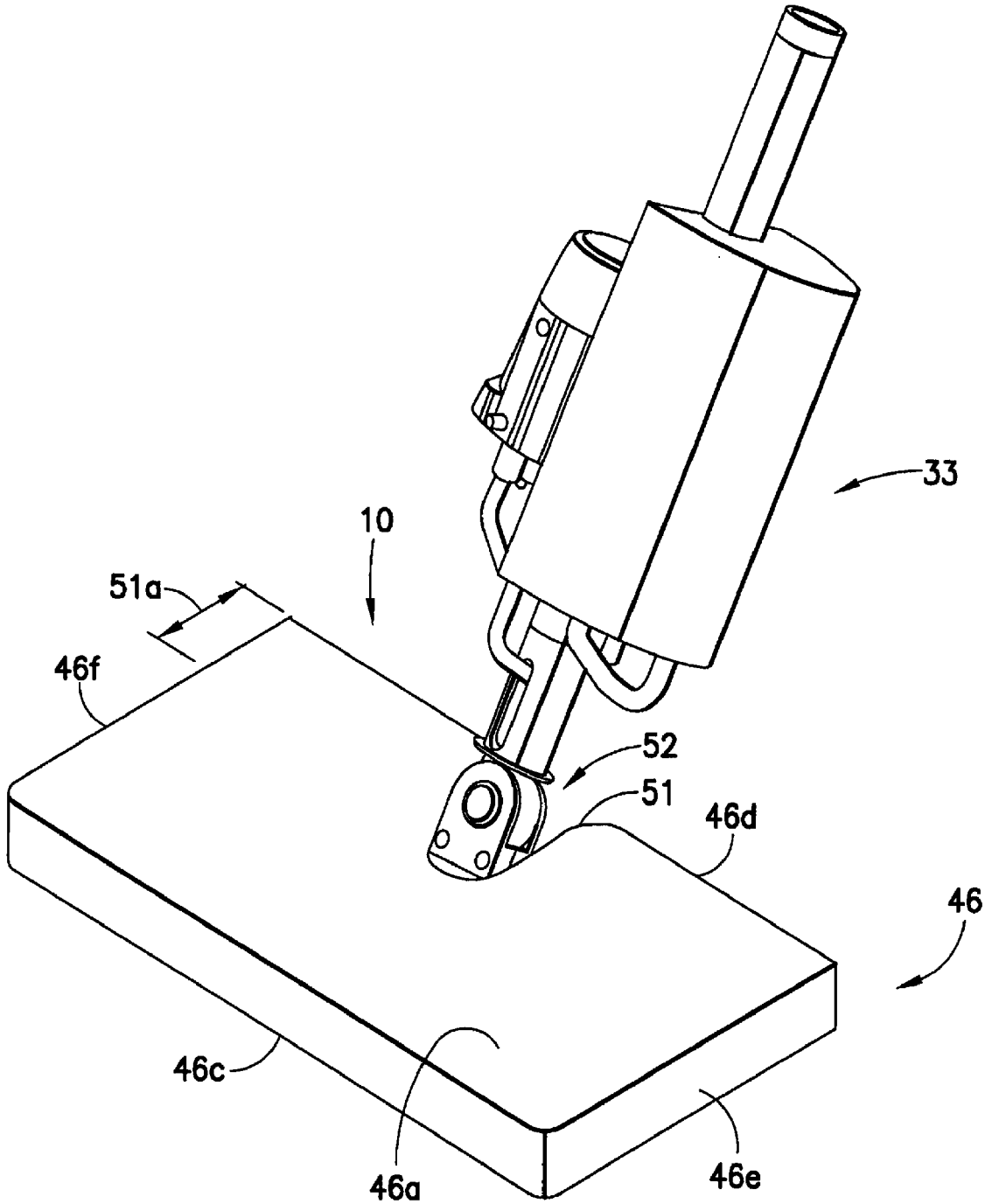
FIG. 1 is a perspective view of a mop frame with cut-out installed on the frame attached having a universal connector and a fabric pocket having a pivot constructed and arranged in accordance with one embodiment of the invention.

FIG. 1 is a perspective new of a steam mop 10 having a housing 33 with a fabric steam pocket 46 attached to a steam frame 12 thereon. The specifics of fabric steam pocket 46 will be described below.

Figure 2:
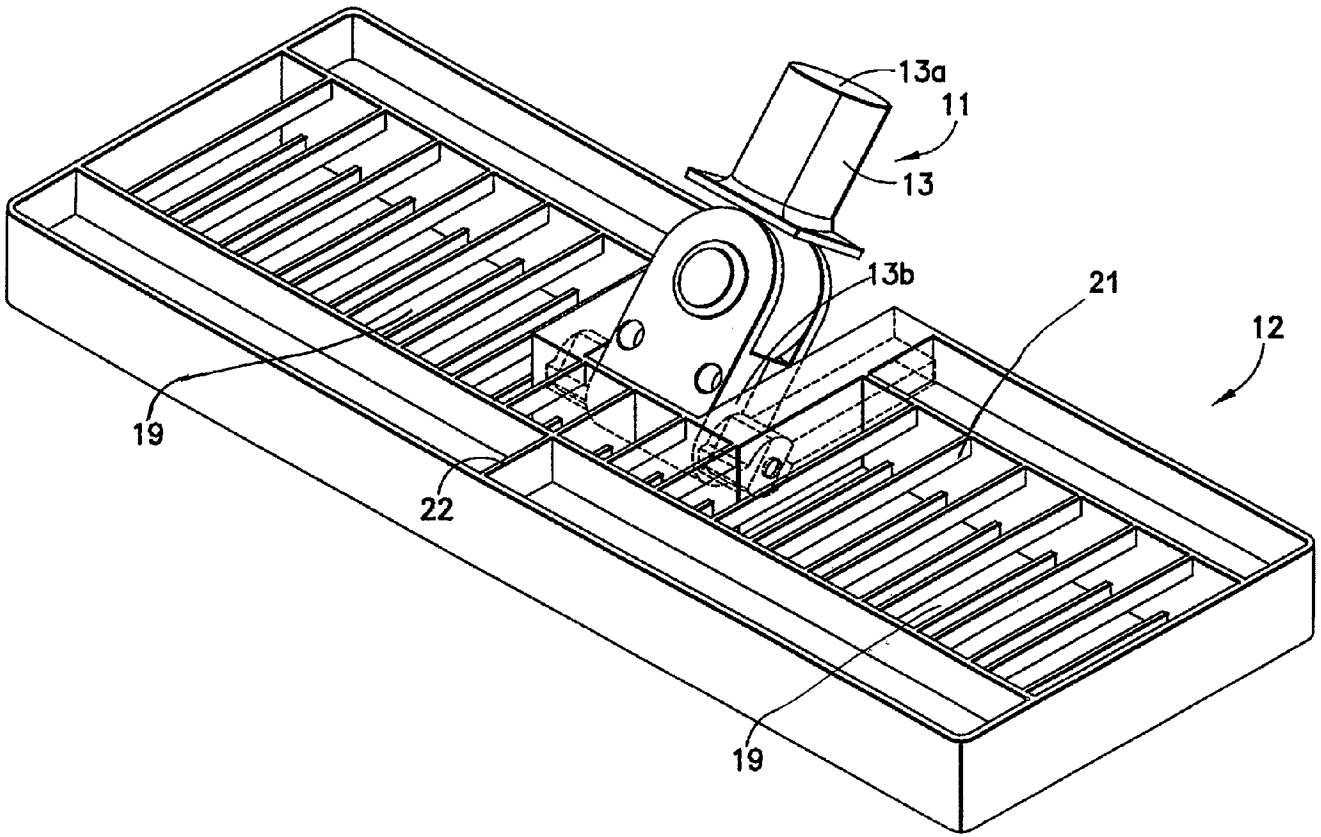
FIG. 2 is a perspective view of the universal connector in the mop of FIG. 1 constructed and arranged in accordance with the invention.
Figure 3:
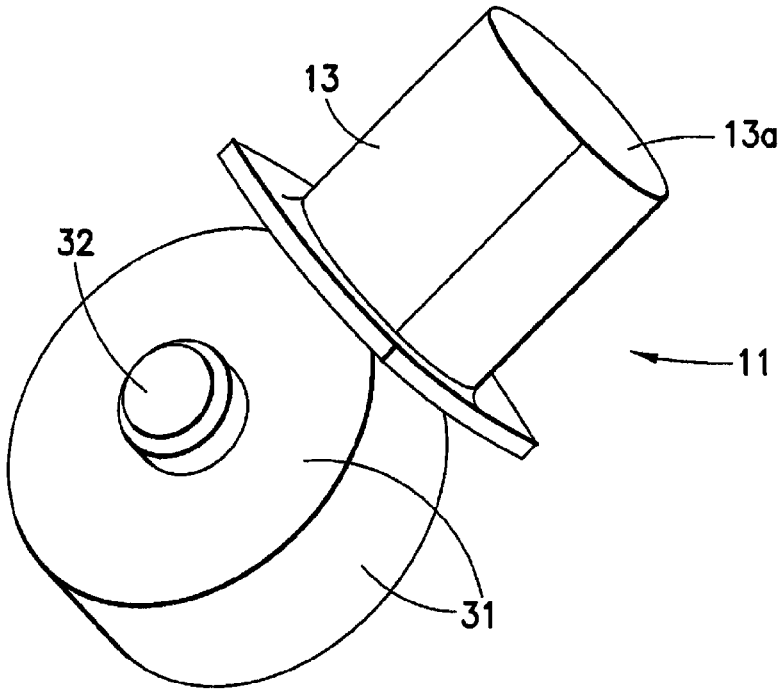
FIG. 3 is a perspective view of an upper connector piece of the universal connector of FIG. 1.
Figure 5:
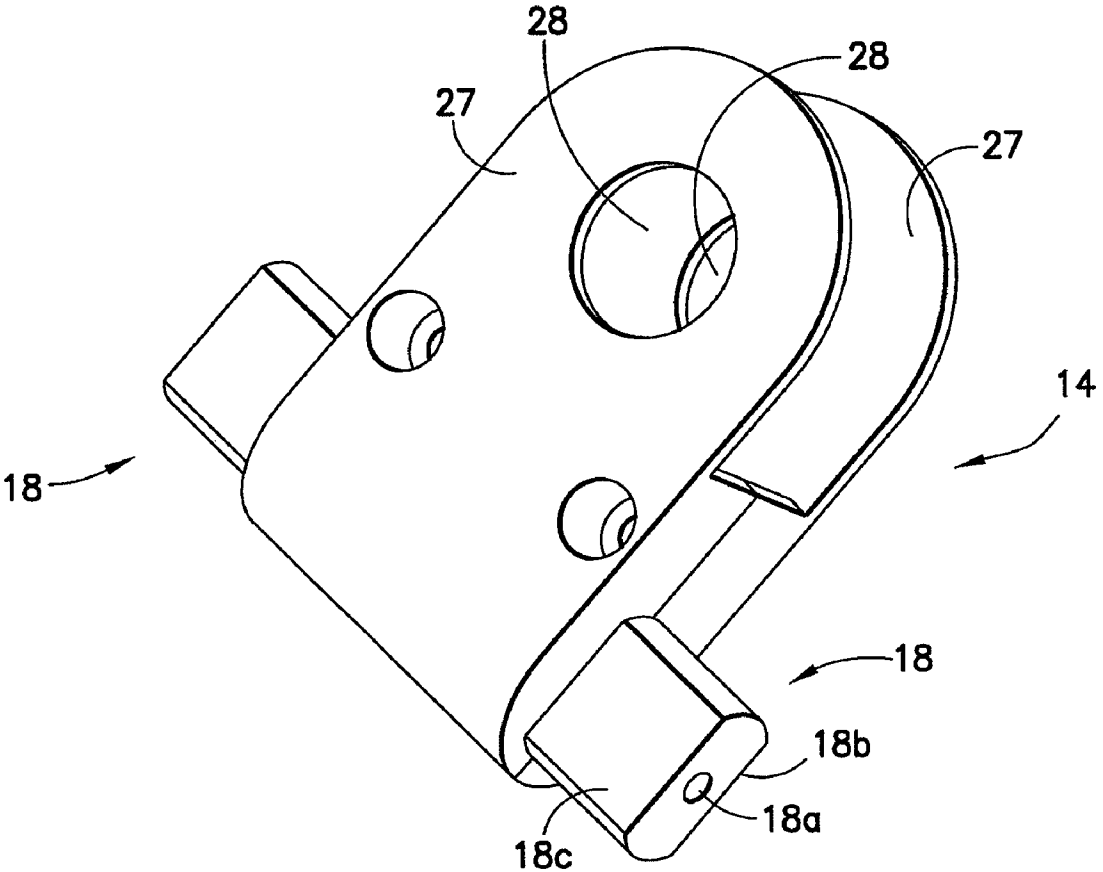
FIG. 5 is a perspective view of a fluid distributor of the universal connector of FIG. 1.

FIG. 2 is a perspective view of universal connector 11 shown mounted on mop frame 12 in accordance with the invention. Here, universal connector 11 includes upper connector piece 13 having a mop housing or pipe end 13*a* that connects to a mop housing 33 (see FIG. 9) and a pair of inner pivot plates 31 with pivot buttons 32 at the other end 13*b* for pivotal connection to a fluid distributor 14 as shown in FIG. 5. Fluid distributor 14 includes a hollow nipple portion 17 and a pair of arms 18 that engages mop frame 12 as will be discussed in more detail below.

Figure 7A:
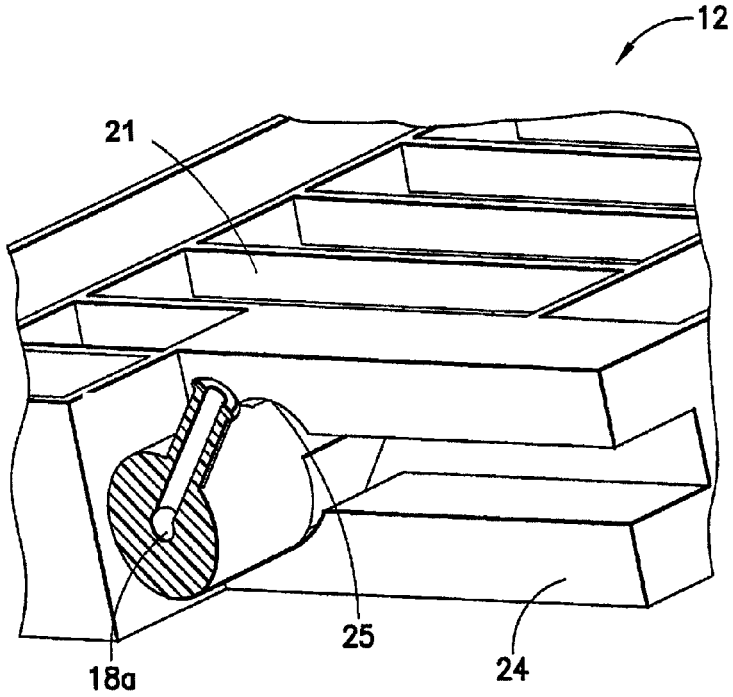
FIGS. 7A and 7B are partial sectional views of mop frame showing the side arms of distributor engaged for use.
Figure 7B:
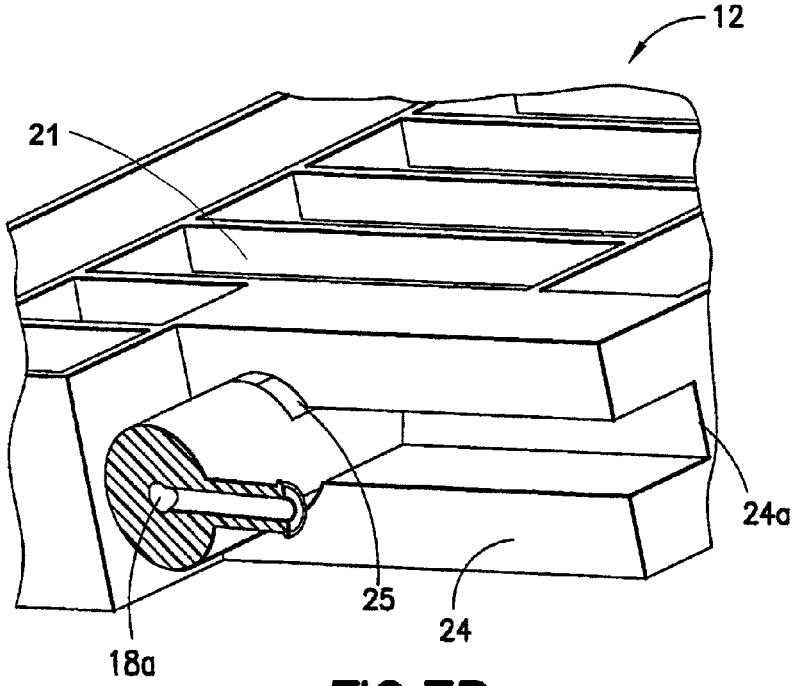

Mop frame 12 as shown is substantially rectangular in shape and includes two steam chambers 19 with a plurality of baffles 21 that are separated by a partition 22. In addition, mop frame 12 also has a pair of receiving slots 23 with a key hole 24 for receiving and for engaging fluid distributor 14 as shown in FIGS. 7A and 7B. Mop frame 12 may be any convenient shape, such as oval or triangular so long as it has appropriate receiving slots 23 for receiving distributor 14.

Figure 4A:
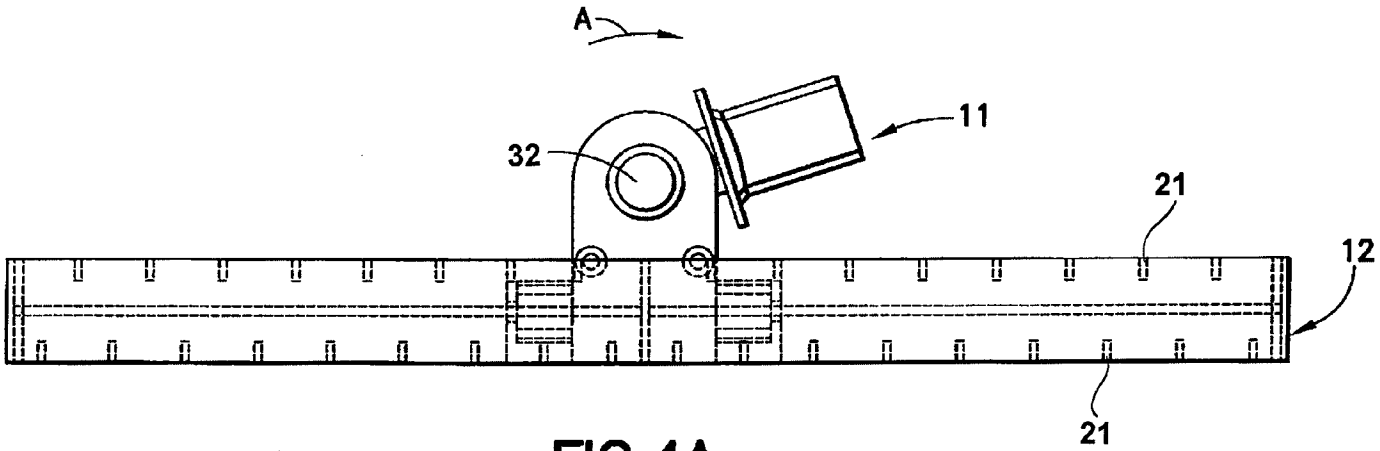
FIGS. 4A and 4B are rear elevational views of the universal connector showing how the connector pivots to the right and left, respectively.
Figure 4B:
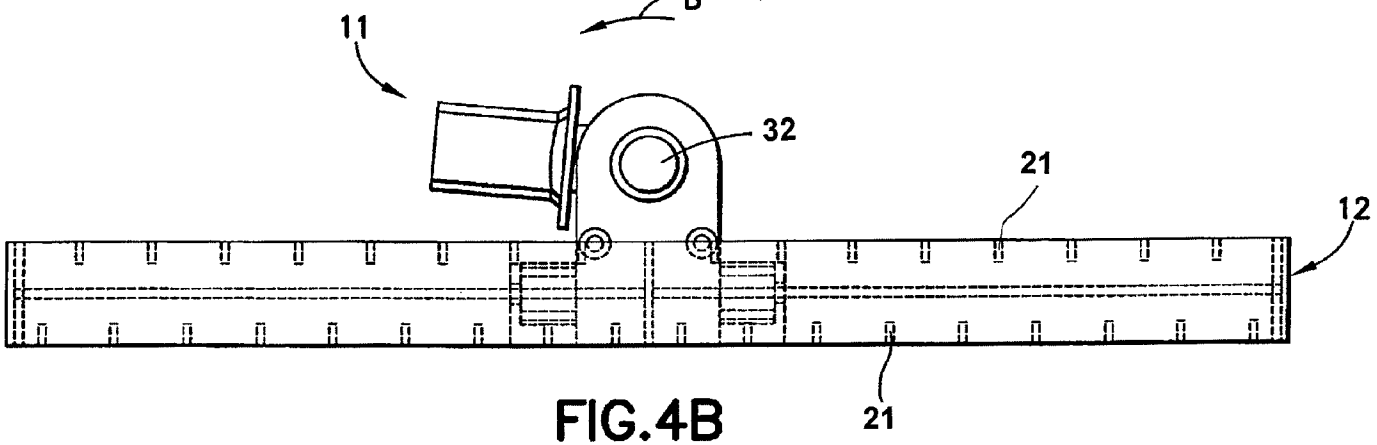

Universal connector 11 rotates or pivots to the right as shown by arrow A and left as shown by arrow B around pivot buttons 32 as shown in FIGS. 4A and 4B.

Figure 6:
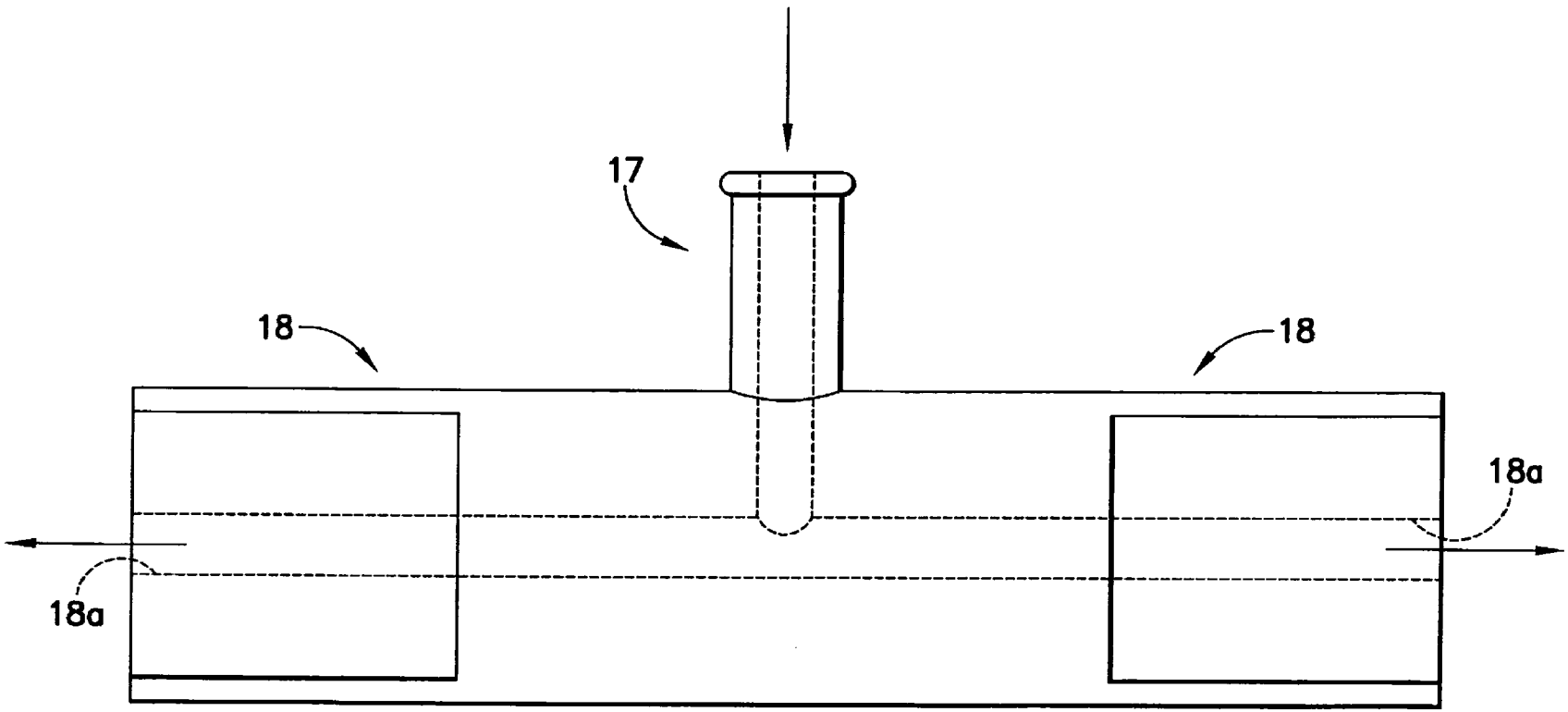
FIG. 6 is an elevational view in partial section of the fluid distributor of FIG. 4.

Referring now to FIG. 5, fluid distributor 14 includes two upwardly extending distributor plates 27 with holes 28 for aligning with pivot holes 32 of upper connector inner pivot plates 31 to provide the right and left pivot connection between upper connector piece 13 and fluid distributor 14. As shown in FIG. 6, fluid distributor 14 includes hollow nipple portion 17 for connecting to the fluid source. Hollow nipple portion 17 in turn connects to upper connector piece 13 and pipe end 13*a* is connected to the fluid source of mop housing 33. Pivot arms 18 that fit into receiving slots 23 of mop frame 12 for connecting universal connector 11 to mop frame 12 for pivoting up and down are also hollow. Each arm 18 includes a fluid opening 18*a*. Distributor arms 18 have two opposed flat surfaces 18*b* and 18*c* at their respective ends for coupling to mop frame 12. Fluid enters hollow nipple portion 17 and is transported through a steam conduit to opening 18*a* to mop frame 12.

In FIGS. 7A and 7B mop frame 12 has a connector opening 25 with a slot 23 on each side of opening 25 and a key hole 24. This provides for easy insertion and engagement of distributor anus 18 and universal connector 11. When engaged in key hole 24, distributor pivot arms 18 pivot up and down.

Figure 8:
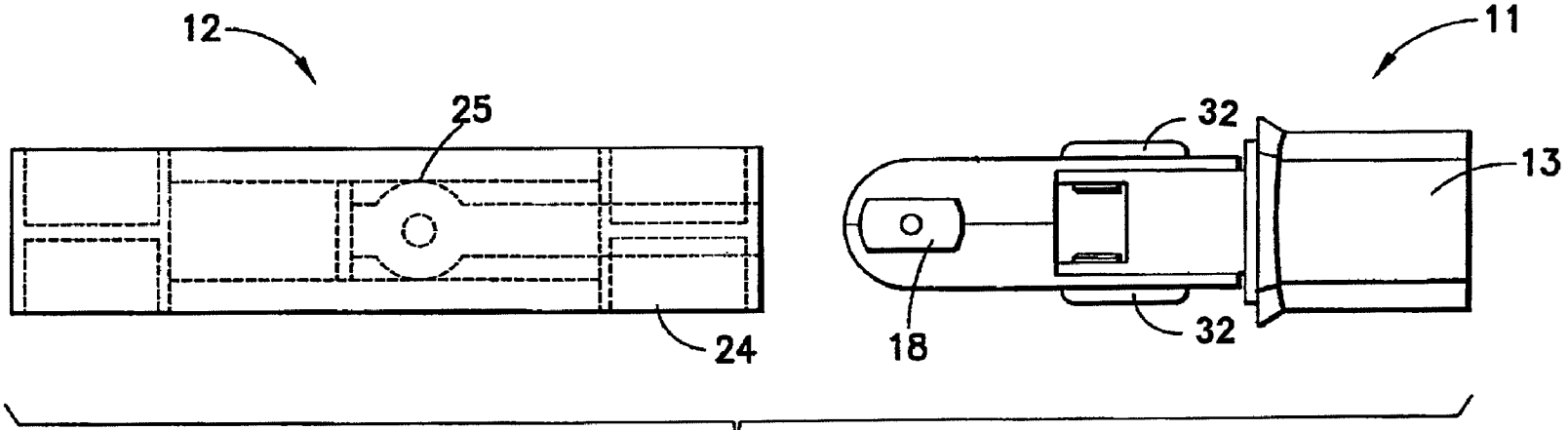
FIG. 8 is a side elevational view of the distributor removed from the mop frame.

FIG. 8 shows fluid distributor 14 as it is withdrawn from opening 25 of mop frame 12. Here, when pivot arms 18 are aligned with slots 23, user can easily reconnect or disconnect universal connector 11 from mop frame 12.

Figure 9:
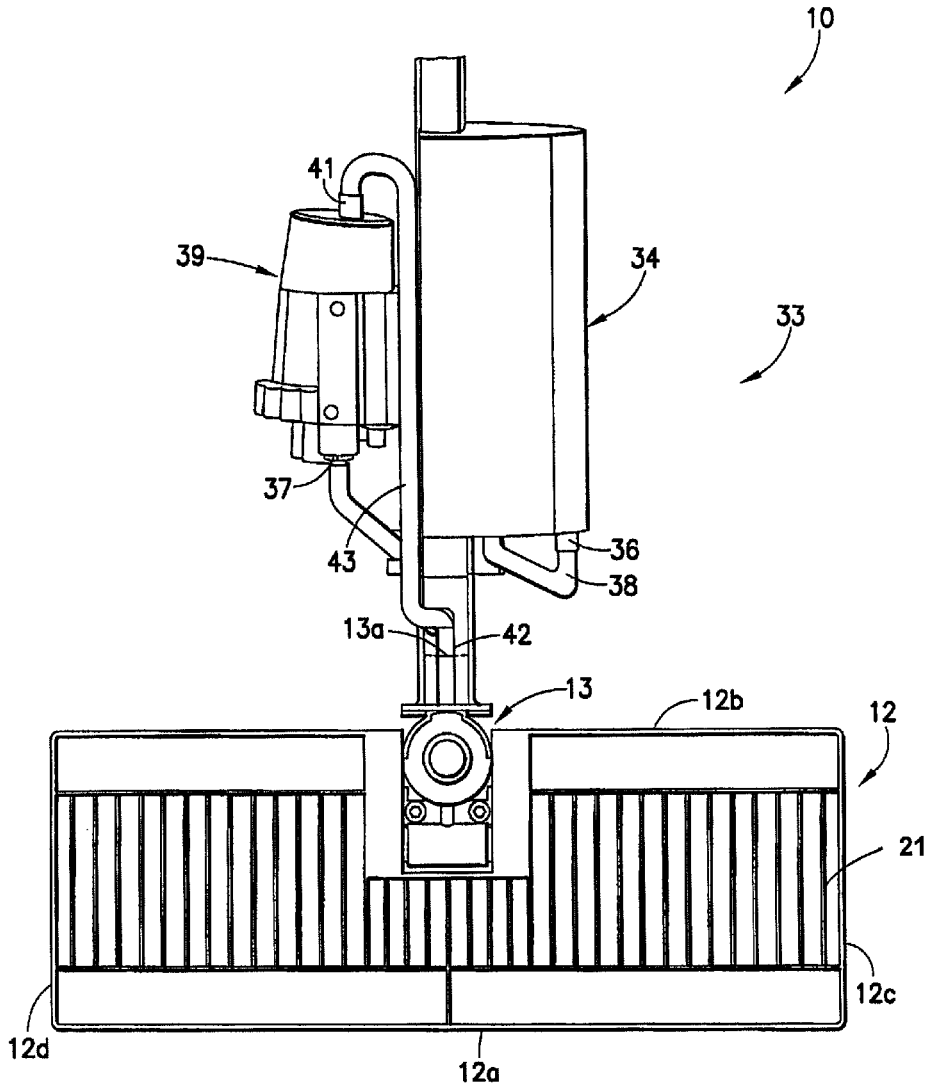
FIG. 9 is a perspective view of the universal connected mounted on mop frame and a mop housing in accordance with one embodiment of the invention.

FIG. 9 illustrates a steam mop 10 having a mop housing 33 with a water tank 34 and a boiler or steam generator 39. Housing 33 is connected to a universal connector 11 mounted for connecting to a mop frame 12. Water tank 34 with a water outlet 36 is connected to steam generator 39 via a water tubing 38. At the other end of water tubing 38 is a water inlet 37 in which water enters steam generator 39. When the water in steam generator 39 is converted to steam, steam exits steam generator 39 through steam outlet 41 via a steam tubing 43. At the other end of steam tubing 43 steam inlet 42 in which steam enters mop an upper connector piece 13 of universal connector 11. The end of steam tubing 43 connects to nipple 17. Steam mop frame 12 includes a front wall 12*a*, a rear wall 12*b*, a right side wall 12*c* and a left side wall 12*d* as shown in FIG. 9.

Referring now to FIG. 1, fabric steam pocket 46 is configured to slip over frame 12. In this respect, it is formed of a first layer of fabric 46*a* and an opposed second layer of fabric 46*b* (not shown), each having a substantially rectangular shape with two opposed long edges 46*c* and 46*d* and two opposed short sides 46*e* and 46*f*. Long edge 46*c* and two opposed short side 46*e* and 46*f* are stitched to form pocket 46. Accordingly, fabric steam pocket 46 is open on long edge 46*d*. The fabric along the opening on long edge 46*d* may be optionally closed with a hook and loop fastener, buttons or snaps. Here, steam pocket 46 is cut along a line 51 to form a slot 52 around the width of universal connector 11 on the first layer 46*a* and opposed second layer 46*b*. Slot 52 has a length a distance 51*a* from rear edge 46*d* to the pair of arms of fluid distributor 14. This allows for vertical rotation of housing 33 without bending the fabric of fabric steam pocket 46 and use both sides of steam pocket for cleaning without having to remove and re-install steam pocket 46.

Figure 10:
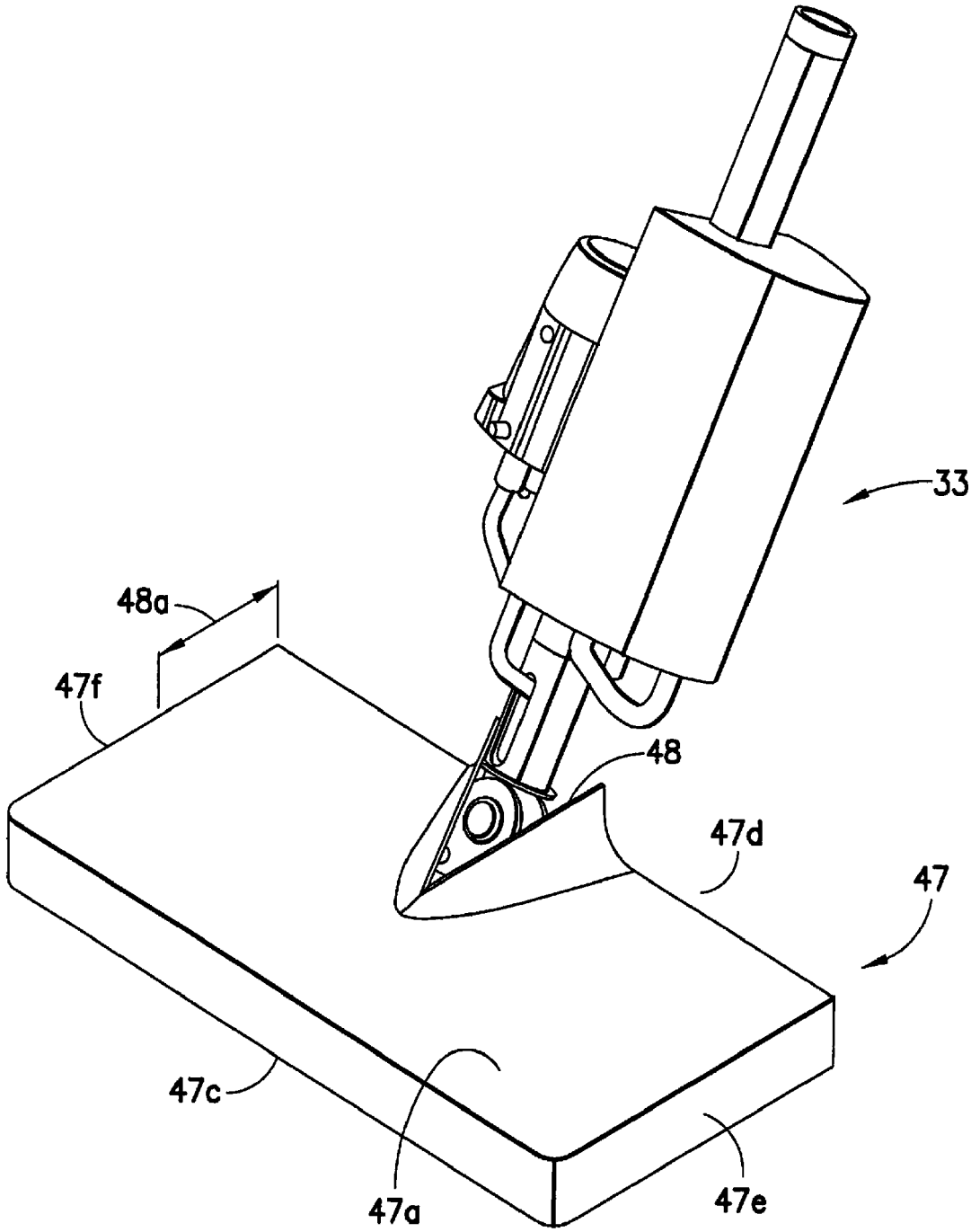
FIG. 10 is a perspective view of a mop frame with the universal connector and a fabric steam pocket having a pivot slit installed in accordance with another embodiment of the invention.

FIG. 10 shows another steam pocket 47 in accordance with another embodiment of the invention. Here, fabric steam pocket 47 is configured to slip over frame 12 and is formed of a first layer of fabric 47*a* and an opposed second layer of fabric 47*b* (not shown). Each layer 47*a*, 47*b* has a rectangular shape with two opposed long edges 47*c* and 47*d* and two opposed short sides 47*e* and 47*f*. Long edge 47*c* and two opposed short sides 47*e* and 47*f* are stitched to form pocket 47. Accordingly, fabric steam pocket 47 is open on long edge 47*d*. The fabric along open edge 47*d* may be optionally closed with a hook and loop fastener, buttons or snaps.

Figure 11:
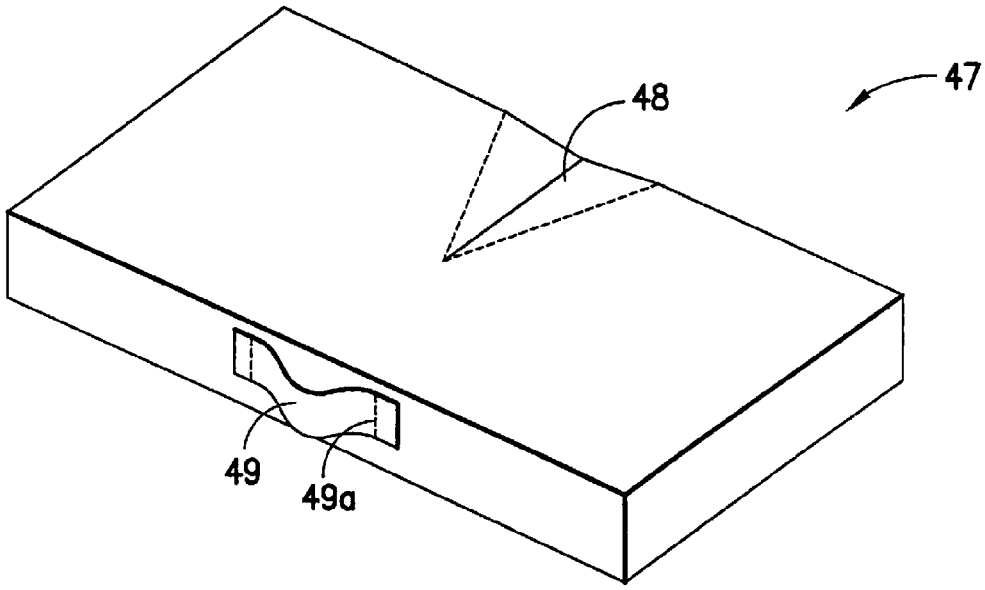
FIG. 11 is a perspective view of fabric steam pocket of FIG. 10 having a tab in accordance with one embodiment of the invention.

FIG. 11 shows steam pocket 47 with a pull tab 49 stitched to long edge 47*c* opposed to slit 48 on long edge 47*d*. Pull tab 49 may be sewn onto the fabric of steam pocket 47 by stitches 49*a*. Pull tab 49 allows a user to remove steam pocket 47 from frame 12 merely by pulling on it. Tab 49 may be added to steam pocket 46 shown in FIG. 1.

In order to accommodate the width of universal connector 11 steam pocket 47 has a pivot slit 48 on first layer 47*a* and opposed second layer 47*b*. Slit 48 has a length 48*a* from rear wall 12*b* to the pair of arms of fluid distributor 14 to allow for vertical rotation without being restricted by fabric steam pocket 47. Slit 48 remains closed on the side of steam pocket facing the floor when in use. This allows user full use of both sides of steam pocket 47 for cleaning.

In the illustrated embodiments, steam pockets 46 and 47 are a cloth or towel. They may be formed of any suitable fabric such as cotton or a synthetic fabric, such as polyester or polyolefin fiber. Preferably, the fabric of pocket 46 and 47 is a microfiber. Most preferably, the microfiber is a synthetic polyester microfiber.

Universal connector 11 provides many advantages for ease of use because it easily connects and disconnects to a mop handle and a mop frame while providing a user with universal steering capability. The user has more control of the mop frame by the universal connection to clean whatever areas that need to be clean and allows use of both sides of steam frame 12 for cleaning. In addition, the mop frame may be rotated so that the user may use both sides of the mop frame to clean. In addition, the universal connector may attached to any variety of differently shaped mop frames.

It will thus be seen that the objects set forth above, among those made apparent from the preceding description, are efficiently attained and, since certain changes may be made in the above product without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

The present invention may be embodied in other specific forms without departing from the spirit or essential attributes of the invention. Accordingly, reference should be made to the appended claims, rather than the foregoing specification, as indicating the scope of the invention.

What is claimed is:

1. A steam mop comprising:

a housing;

a steam source having steam outlet tubing;

a mop frame having a steam outlet; and a universal connector configured to detachably connect the mop frame to the housing, the universal connector including:

a first connector piece including a first end with a first pair of pivot plates and an interior, a second connector piece having a first end with a second pair of pivot plates for pivotal connection to the first pair of pivot plates of the first connector piece for side to side pivot, and further including a second end with a pair of pivot arms, the pair of pivot arms being connected to the mop frame and permitting up and down pivoting of the connector relative to the mop frame, and a hollow nipple included in the universal connector and in communication with a steam conduit within the universal connector to conduct steam to the mop frame, wherein the steam outlet tubing of the steam source passes into the interior of first connector piece and is connected with the nipple when the universal connector is connected to the housing.

2. The steam mop of claim 1, wherein the mop frame is substantially rectangular in shape.

3. The steam mop of claim 1, wherein the mop frame is substantially triangular in shape.

4. The steam mop of claim 1, wherein the mop frame includes first and second slots, and a first pivot arm of the pair of pivot arms of the second connector piece is engaged in the first slot, and a second pivot arm of the pair of pivot arms of the second connector piece is engaged in the second slot.

5. A steam appliance comprising:

a housing including a steam generator, the steam generator including a steam outlet;

a steam frame adapted to support a steam pocket; and a connector configured to connect the steam frame to the housing, and further configured such that the steam frame is in communication with the steam outlet; wherein:

to change an angle between the housing and the steam frame, the connector is configured to pivot in a side-to-side motion and further configured to pivot in an up and down motion;

the steam frame includes first and second opposed cleaning sides configured to permit use of two cleaning sides of the steam pocket when the steam pocket is mounted thereon, and the steam frame includes at least one steam chamber which is configured to release steam to the steam pocket when the steam pocket is mounted thereon and steam is generated; and the connector is capable of pivoting in the side-to-side motion and in the up and down motion both when the first cleaning side of the steam frame is used for cleaning and when the steam frame is turned over and the second cleaning side of the steam frame is used for cleaning.

6. The steam appliance of claim 5, wherein the connector includes a hollow nipple portion configured to be in communication with the steam generator when the connector is connected to the housing, and connected to a steam conduit within the connector for conducting steam to the mop frame.

7. The steam appliance of claim 6, wherein the steam generator has steam outlet tubing, and the steam outlet tubing of the steam generator passes into the connector and is connected with the nipple portion when the connector is connected to the housing, and wherein the hollow nipple portion is included in the connector.

8. The steam appliance of claim 5, wherein the steam frame includes a connector opening such that the connector is engaged with the steam frame inwardly from a rear wall of the steam frame.

9. The steam appliance of claim 8, wherein the steam frame comprises a plurality of baffles.

10. The steam appliance of claim 8, further comprising the steam pocket, wherein the steam pocket has first and second fabric layers, each fabric layer having a slot extending from an edge of the fabric layer, the slots being configured to permit pivoting of the steam frame and the housing relative to each other when the steam pocket is mounted to the steam frame.

11. The steam appliance of claim 8, wherein the connector is disconnectable from an appliance handle.

12. The steam appliance of claim 8, wherein the connector comprises a universal connector.

13. The steam appliance of claim 8, further comprising steam openings positioned within the steam frame when the connector connects the steam frame to the housing, the steam openings configured to release steam in a direction parallel to a rear wall of the steam frame when steam is generated.

14. The steam appliance of claim 8, wherein the connector is configured to pivot in an up and down motion about an axis which is perpendicular to an axis about which the connector is configured to pivot in a side-to-side motion.

15. The steam appliance of claim 14, wherein the connector is configured to pivot in the side-to-side motion about a first axis, and is configured to pivot in the up and down motion about a second axis, wherein the first axis is perpendicular but non-intersecting with the second axis.

16. The steam appliance of claim 8, further comprising a fluid conduit passing through the connector, the fluid conduit being configured such that the steam frame is in communication with the steam outlet.

17. The steam appliance of claim 16, wherein the fluid conduit is flexible.

18. The steam appliance of claim 8, wherein the steam frame has a perimeter, and the connector is connected to the steam frame inside the perimeter of the steam frame.

19. The steam mop of claim 1, wherein the mop frame is easily connectable to the housing and easily disconnectable from the housing.

20. The steam mop of claim 1, wherein the mop frame has at least one steam chamber.

21. The steam mop of claim 1, wherein the first pair of pivot plates comprises a first pair of buttons.

22. The steam mop of claim 1, further comprising a fabric configured to be attached to a cleaning side of the mop frame.

* * * * *

UNITED STATES PATENT AND TRADEMARK OFFICE

CERTIFICATE OF CORRECTION

PATENT NO. : 8,052,342 B2
APPLICATION NO. : 12/118015
DATED : November 8, 2011
INVENTOR(S) : Maximilian Rosenzweig et al.

It is certified that error appears in the above-identified patent and that said Letters Patent is hereby corrected as shown below:

In the Claims, column 5, line 11, should read:

--source passes into the interior of the first connector piece--

Signed and Sealed this
Ninth Day of April, 2013

Teresa Stanek Rea
*Acting Director of the United States Patent and Trademark Office*